US012071280B2

(12) United States Patent
Andre-Guern

(10) Patent No.: US 12,071,280 B2
(45) Date of Patent: Aug. 27, 2024

(54) METALLIC END CLOSURE FOR SMALL DIAMETER CONTAINER

(71) Applicant: Ball Corporation, Westminster, CO (US)

(72) Inventor: Florian Andre-Guern, Quimper (FR)

(73) Assignee: BALL CORPORATION, Westminster, CO (US)

( * ) Notice: Subject to any disclaimer, the term of this patent is extended or adjusted under 35 U.S.C. 154(b) by 0 days.

(21) Appl. No.: 18/150,700

(22) Filed: Jan. 5, 2023

(65) Prior Publication Data

US 2023/0227213 A1 Jul. 20, 2023

Related U.S. Application Data

(60) Provisional application No. 63/296,567, filed on Jan. 5, 2022.

(51) Int. Cl.

| | |
|---|---|
| ***B65D 41/42*** | (2006.01) |
| ***B21D 51/38*** | (2006.01) |
| ***B65D 51/24*** | (2006.01) |

(52) U.S. Cl.

CPC ..... *B65D 41/42* (2013.01); *B21D 51/383* (2013.01); *B65D 51/243* (2013.01); *B65D 2401/15* (2020.05)

(58) Field of Classification Search

CPC .. B65D 41/42; B65D 51/243; B65D 2401/15; B65D 17/401; B21D 51/383

USPC ..... 215/254

See application file for complete search history.

(56) References Cited

U.S. PATENT DOCUMENTS

| | | | | |
|---|---|---|---|---|
| 5,829,623 | A | 11/1998 | Otsuka et al. | |
| 7,926,675 | B2 | 4/2011 | Rieck et al. | |
| 8,157,119 | B2 | 4/2012 | Watson et al. | |
| 9,938,043 | B2 | 4/2018 | Chasteen et al. | |
| 2014/0353318 | A1 * | 12/2014 | Fields | B65D 7/36 220/619 |
| 2019/0060977 | A1 * | 2/2019 | Macke | B21D 51/383 |
| 2019/0112096 | A1 * | 4/2019 | Gogola | B21D 51/383 |
| 2019/0224738 | A1 * | 7/2019 | Stammen | B65D 17/401 |
| 2020/0017936 | A1 | 1/2020 | Melancon et al. | |
| 2023/0016790 | A1 * | 1/2023 | Macke | B21D 51/26 |
| 2023/0035259 | A1 * | 2/2023 | Whittaker | B65D 17/401 |
| 2023/0286033 | A1 * | 9/2023 | Stammen | B65D 41/40 220/272 |

FOREIGN PATENT DOCUMENTS

| | | | | |
|---|---|---|---|---|
| JP | 2000-159229 | | 6/2000 | |
| JP | 2002-145263 | | 5/2002 | |
| WO | WO-2005032953 | A2 * | 4/2005 | B21D 51/32 |
| WO | WO-2007014211 | A1 * | 2/2007 | B65D 17/08 |
| WO | WO-2021016415 | A2 * | 1/2021 | B65D 17/08 |

* cited by examiner

*Primary Examiner* — J. Gregory Pickett
*Assistant Examiner* — Niki M Eloshway
(74) *Attorney, Agent, or Firm* — Sheridan Ross P.C.

(57) ABSTRACT

The present disclosure generally relates to containers and container end closures, and more specifically metallic end closures for small diameter metallic beverage containers. The present disclosure also relates to the tooling used to form the novel end closure, where the tooling is itself novel. The change of the angles on the die core ring improve the mobility of the metal while forming the end closure. Specifically, when manufacturing the new end closure with the new tooling, the press output is increased by over five times.

9 Claims, 13 Drawing Sheets

METALLIC END CLOSURE FOR SMALL DIAMETER CONTAINER

CROSS-REFERENCE TO RELATED APPLICATIONS

This application claims priority from U.S. Provisional Patent Application Ser. No. 63/296,567, filed Jan. 5, 2022, entitled "Metallic End Closure For Small Diameter Container," the entire disclosure of which is hereby expressly incorporated by reference in its entirety.

FIELD OF THE INVENTION

Embodiments of the present invention generally relate to containers and container end closures, and more specifically metallic end closures for small diameter metallic beverage containers.

BACKGROUND OF THE INVENTION

Containers, and more specifically metallic beverage containers, generally contain a neck on an upper portion that is adapted for interconnection to a metallic end closure. The container end closure is formed from a flat sheet of metallic material and generally includes a pull tab or other form of stay on tab ("SOT"). Beverage containers commonly store carbonated beverages, thus, both the container body and the container end closure are required to withhold internal pressures up to 90 psi while under varying temperatures without catastrophic failure or permanent deformation. Further, the container end closure must be manufactured, stacked, shipped, and sent to a filler prior to being seamed onto a container body filled with a carbonated beverage. Thus, the container and end closure must be designed to resist deformation and failure while utilizing thin metallic materials and allowing compact stacking during shipping and manufacturing.

Food and beverage containers with pull tabs or SOTs are generally known. Various SOTs and related features are disclosed, by way of example, in U.S. Pat. No. 7,926,675 to Rieck et al., the entire disclosure of which is hereby incorporated by reference in its entirety. Known end closures, however, generally may buckle when under varying temperatures and internal pressure. If an end closure buckles on the side with the score line and opening, then the score line may crack and release the contents of the container. This is called "peak and leak."

Runability is very important when making end closures. Runability refers to the line output efficiency. Runability can be measured by how many items (here, end closures) can be manufactured during a shift and/or how long the manufacturing equipment can run (or how many end closures the equipment can manufacture) before there is an issue, for example an end closure gets stuck and stops the process, scraps/shard build up and cause defective end closures, a piece of the equipment breaks, etc. The more efficient the line output, the better the runability, and the more money is saved, i.e., the more the price per item (end closure) is reduced. In other words, the more end closures you can make in one shift (typically 8 hours), the cheaper each end closure costs. Moreover, if you can double the line output for each shift, then you can reduce your amount of equipment and manufacturing personnel by about half and still make the same number of end closures.

Over the years, container manufacturers continue to make smaller and smaller diameter end closures and corresponding container necking to reduce the amount of material used and, thus, the cost to manufacture the end closures and containers. A small amount of material saved equates to large cost savings when making a large number of end closures.

SUMMARY OF THE INVENTION

Due to the numerous limitations associated with the prior art, the following disclosure describes an improved container end closure that is adapted for interconnection to a container body and that has a smaller diameter, which reduces material costs and improves buckle strength based on the novel design of the end closure.

These and other needs are addressed by the various embodiments and configurations of the present invention. This invention relates to a novel system, device, and methods for providing a food and beverage container end closure for smaller diameter metallic beverage containers. The novel end closure provided herein reduces the material used to make the end closure, which reduces the cost of the end closure and still has the same strength and buckle resistance of prior art designs.

Features of the present invention may be employed in a wide range of food and beverage containers, including pressurized beverage containers with SOTs secured by a rivet, food containers with tear away lids, and full panel easy-open end tabs, to name a few. Although the invention generally relates to metallic end closures and containers, the invention and features described herein could easily be implemented on plastic containers and end closures.

Thus, it is one aspect of various embodiments of the present invention to provide a metallic end closure that uses less material than prior art end closures.

It is one aspect of various embodiments of the present invention to provide an end closure that does not compromise strength and buckle resistance while also reducing cost.

In another aspect of the present invention, a container end closure is provided that is manufactured with conventional manufacturing equipment.

It is also an aspect of various embodiments of the present invention to provide improved tooling to manufacture end closures, such that the improved tooling increases the number of end closures made per shift and increases the line output efficiency.

In some embodiments, a modified die core ring and/or a modified inner pressure sleeve are used on the press, i.e., the machine used to make the end closures. Presses typically operate at 600 strokes per minute. Embodiments of the end closure described herein are less likely to stick in the manufacturing equipment due to the new tooling geometry, i.e., the new angle and radii on the die core ring and inner pressure sleeve, in combination with the specific coating used on the sheet metal. End closures of the prior art would get stuck in the machine, specifically the press would get jammed when discharging the prior art end closures, thus causing significant downtime and cost. The modified tooling changes the radius of curvature of the end closure chuckwall. This modification had the unexpected result of preventing the end closure from getting stuck and thus causing costly downtime. In some embodiments, the dimensional change in the tooling, specifically the die core ring, improves the press output per shift (i.e., end closures made per shift) by over five (5) times.

In one embodiment, a container end closure adapted for interconnection to a container body is provided. The metallic end closure comprises: a peripheral curl which is adapted for interconnection to a neck of a beverage container; a chuckwall extending downwardly from said peripheral curl; a countersink interconnected to a lower end of said chuckwall; an inner panel wall extending upwardly from an interior portion of said countersink; a substantially linear panel wall interconnected to an upper portion of said inner panel wall; a center panel interconnected to an upper portion of said substantially linear panel wall; a pull tab having a nose end and a tail end which is operably interconnected to said central panel; a first score line in said central panel which defines a tear panel; and an overall end diameter measured from an outer edge of the unseamed peripheral curl of about 2.240 inches.

In some embodiments, an uppermost point of the peripheral curl is positioned between about 0.2 inch and 0.3 inch above a lowermost portion of the countersink. In various embodiments, the chuckwall comprises an upper linear portion interconnected to a curved portion at a first junction, wherein the curved portion has a radius of curvature between about 0.06 and 0.08 inch and the first junction has a radius of curvature between about 0.025 and 0.04 inch. In some embodiments, the substantially linear panel wall is position at an angle between about 30° and about 60° relative to a horizontal plane. In various embodiments, the countersink comprises an inner radius of curvature and an outer radius of curvature, wherein the inner radius of curvature is between about 0.02 inch and 0.035 inch and the outer radius of curvature is between about 0.015 inch and 0.03 inch.

A metallic beverage container, comprising: a container body comprising a closed bottom end, an open upper end, and a cylindrical sidewall; a neck interconnected to the open upper end of the container body; and an end closure interconnected to the neck, the end closure comprising: a peripheral curl which is adapted for interconnection to a neck of a beverage container; a chuckwall extending downwardly from said peripheral curl; a countersink interconnected to a lower end of said chuckwall; an inner panel wall extending upwardly from an interior portion of said countersink; a substantially linear panel wall interconnected to an upper portion of said inner panel wall; a center panel interconnected to an upper portion of said substantially linear panel wall; a pull tab having a nose end and a tail end which is operably interconnected to said central panel; a first score line in said central panel which defines a tear panel; and a diameter measured from an outer edge of the unseamed peripheral curl of about 2.240 inches.

Various methods of forming an end closure are provided. In one embodiment, a method of manufacturing a metallic end closure is provided comprising: providing a metallic blank; and forming the metallic blank into an end closure comprising: a peripheral curl which is adapted for interconnection to a neck of a beverage container; a chuckwall extending downwardly from said peripheral curl; a countersink interconnected to a lower end of said chuckwall; an inner panel wall extending upwardly from an interior portion of said countersink; a center panel interconnected to an upper portion of said inner panel wall; a pull tab having a nose end and a tail end which is operably interconnected to said central panel; a first score line in said central panel which defines a tear panel; and a diameter measured from an outer edge of the unseamed peripheral curl of about 2.240 inches.

The end closures can be made of any metal known and used in the art. In preferred embodiments, the end closures are comprised of an aluminum alloy. For the purpose of further disclosure, the following references related to metal used for end closures are incorporated by reference in their entireties: U.S. Provisional Patent Application No. 61/906,796 and U.S. Patent Publication No. 2020/0017936.

For purposes of further disclosure, the following references generally related to end panels and SOTs are hereby incorporated by reference in their entireties:

- Japanese Patent Publication Number JP2002145263 to Yoshihiko;
- Japanese Patent Publication Number JP2000159229 to Yoshihik;
- U.S. Pat. No. 5,829,623 issued to Otsuka et al. on Nov. 3, 1998; and
- U.S. Pat. No. 8,157,119 issued to Watson et al. on Apr. 17, 2012.

The phrases "at least one," "one or more," and "and/or," as used herein, are open-ended expressions that are both conjunctive and disjunctive in operation. For example, each of the expressions "at least one of A, B and C," "at least one of A, B, or C," "one or more of A, B, and C," "one or more of A, B, or C," and "A, B, and/or C" means A alone, B alone, C alone, A and B together, A and C together, B and C together, or A, B, and C together.

Unless otherwise indicated, all numbers expressing quantities, dimensions, conditions, and so forth used in the specification and claims are to be understood as being modified in all instances by the term "about".

The term "a" or "an" entity, as used herein, refers to one or more of that entity. As such, the terms "a" (or "an"), "one or more," and "at least one" can be used interchangeably herein.

The use of "including," "comprising," or "having" and variations thereof herein is meant to encompass the items listed thereafter and equivalents thereof as well as additional items. Accordingly, the terms "including," "comprising," or "having" and variations thereof can be used interchangeably herein.

It shall be understood that the term "means" as used herein shall be given its broadest possible interpretation in accordance with 35 U.S.C. § 112(f). Accordingly, a claim incorporating the term "means" shall cover all structures, materials, or acts set forth herein, and all of the equivalents thereof. Further, the structures, materials, or acts and the equivalents thereof shall include all those described in the summary of the invention, brief description of the drawings, detailed description, abstract, and claims themselves.

These and other advantages will be apparent from the disclosure of the invention(s) contained herein. The above-described embodiments, objectives, and configurations are neither complete nor exhaustive. The Summary of the Invention is neither intended nor should it be construed as being representative of the full extent and scope of the present invention. Moreover, references made herein to "the present invention" or aspects thereof should be understood to mean certain embodiments of the present invention and should not necessarily be construed as limiting all embodiments to a particular description. The present invention is set forth in various levels of detail in the Summary of the Invention as well as in the attached drawings and the Detailed Description and no limitation as to the scope of the present invention is intended by either the inclusion or non-inclusion of elements, components, etc. in this Summary of the Invention. Additional aspects of the present invention will become more readily apparent from the Detailed Description, particularly when taken together with the drawings.

BRIEF DESCRIPTION OF THE DRAWINGS

Those of skill in the art will recognize that the following description is merely illustrative of the principles of the invention, which may be applied in various ways to provide many different alternative embodiments. This description is made for illustrating the general principles of the teachings of this invention and is not meant to limit the inventive concepts disclosed herein.

The accompanying drawings, which are incorporated in and constitute a part of the specification, illustrate embodiments of the invention and together with the general description of the invention given above and the detailed description of the drawings given below, serve to explain the principles of the invention.

Figure 1:
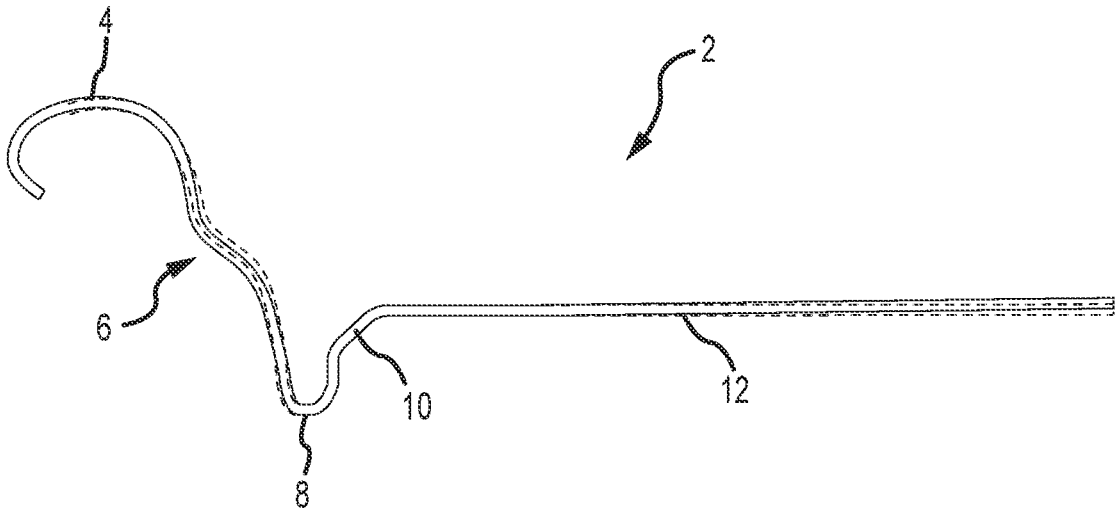
FIG. 1 shows the cross-sections of two embodiments of the present small-diameter end closures.

It should be understood that the drawings are not necessarily to scale, and various dimensions may be altered. In certain instances, details that are not necessary for an understanding of the invention or that render other details difficult to perceive may have been omitted. It should be understood, of course, that the invention is not necessarily limited to the particular embodiments illustrated herein.

DETAILED DESCRIPTION

Although the following text sets forth a detailed description of numerous different embodiments, it should be understood that the legal scope of the description is defined by the words of the claims set forth at the end of this disclosure. The detailed description is to be construed as exemplary only and does not describe every possible embodiment since describing every possible embodiment would be impractical, if not impossible. Numerous alternative embodiments could be implemented, using either current technology or technology developed after the filing date of this patent, which would still fall within the scope of the claims. To the extent that any term recited in the claims at the end of this patent is referred to in this patent in a manner consistent with a single meaning, that is done for sake of clarity only so as to not confuse the reader, and it is not intended that such claim term by limited, by implication or otherwise, to that single meaning.

Various embodiments of the present invention are described herein and as depicted in the drawings. It is expressly understood that although the figures depict metal end closures, container bodies, scores, and methods and systems for using the same, the present invention is not limited to these embodiments. It should also be understood that the terms "container" and "container body"; "end closure" and "container end closure"; "tear panel" and "tear portion"; "opening" and "pour opening"; and "main" and "primary" may be used interchangeably in some instances.

Referring to FIG. 1, the cross-sections of two embodiments of the present small-diameter end closures 2 are shown. One embodiment is the 200 CDL standard end closure 2 (shown in solid lines) and the other embodiment is the 200 CDL-E end closure 2 (shown in dashed lines). The end closures 2 each have a peripheral curl 4 connected to a chuckwall 6, which is connected to a countersink 8, which is connected to an inclined linear panel 10, which is connected to the center panel 12. In FIG. 1, the peripheral curls 4 of the two end closures 2 are aligned.

Figure 2:
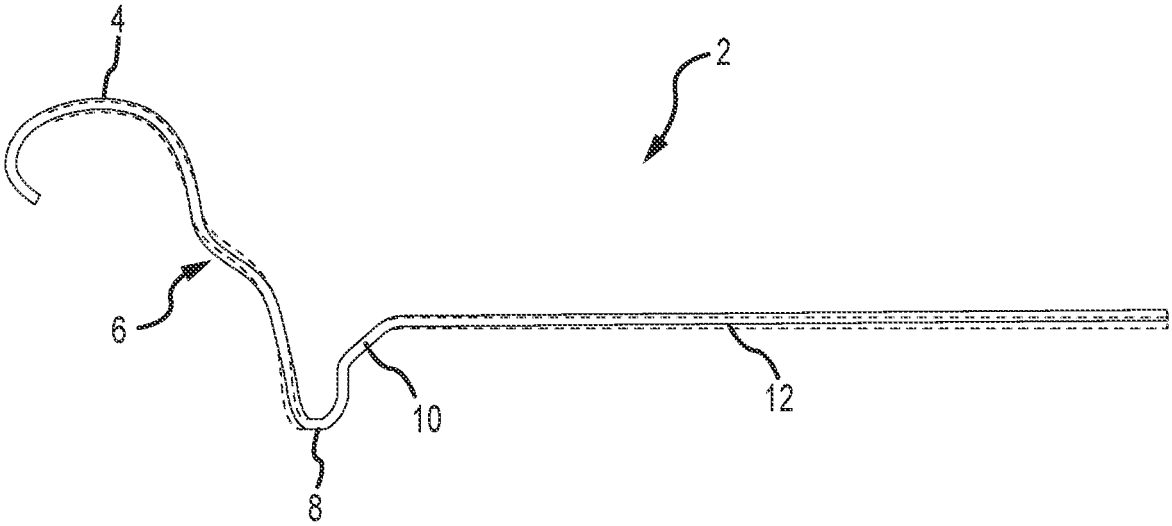
FIG. 2 shows the cross-sections of two embodiments of the present small-diameter end closures.

Referring to FIG. 2, the cross-sections of two embodiments of the present small-diameter end closures 2 are shown. One embodiment is the 200 CDL standard end closure (shown in solid lines) and the other embodiment is the 200 CDL-E end closure (shown in dashed lines). In FIG. 2, the inclined linear panels 10 of the two end closures 2 are aligned.

The 200 CDL standard end closure 2 in FIGS. 1 and 2 is formed by the inner pressure sleeve leading (i.e., IPS leading), which is an improvement over the prior art. The 200 CDL-E end closure in these figures is formed by the die core or die center leading ("DCL") using a new and novel die core ring.

Figure 3:
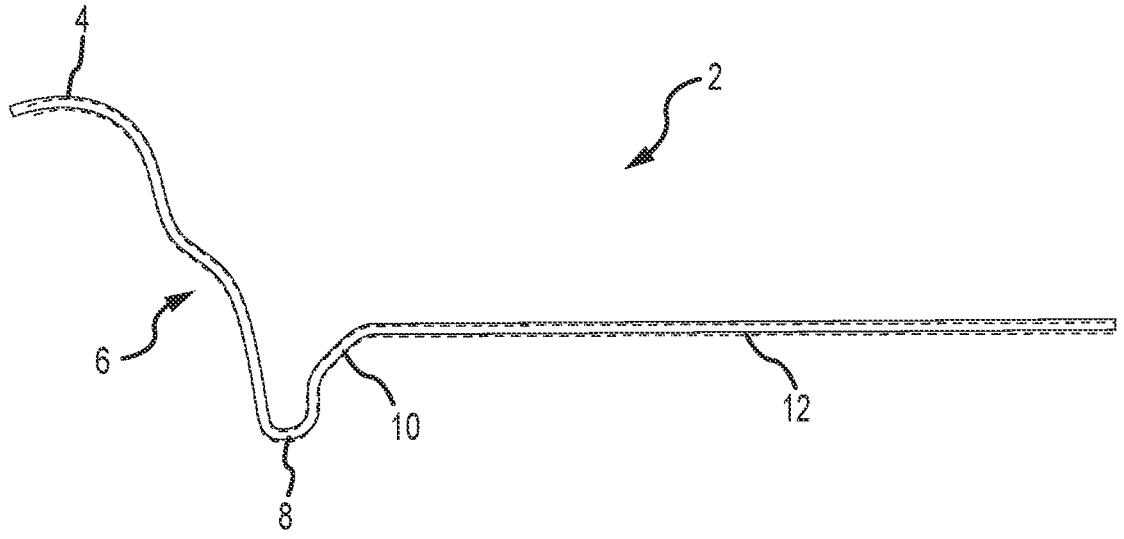
FIG. 3 is a cross-section of an end closure according to one embodiment of the present invention with a cross-section of an end closure according to another embodiment of the present invention.

Referring to FIG. 3, a cross-section of an end closure 2 according to one embodiment of the present invention (the 200 CDL-E IPSL end closure, shown in solid lines) is shown with a cross-section of an end closure according to another embodiment of the present invention (200 CDL-E DCL end closure, shown in dashed lines). In this figure, the chuckwalls 6 of the two embodiments are aligned. One difference between the 200 CDL-E IPSL end closure and the 200 CDL-E DCL end closure is the way each end closure is formed. As discussed above, the DCL end closure is formed via the die core leading whereas the IPSL is formed by the inner pressure sleeve leading.

Figure 4:
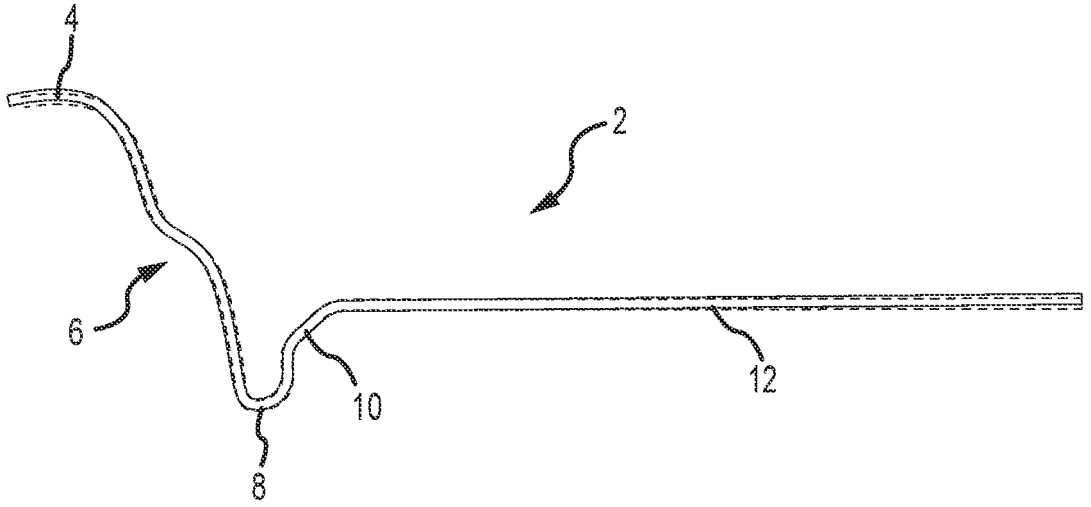
FIG. 4 is a cross-section of an end closure according to one embodiment of the present invention with a cross-section of an end closure according to another embodiment of the present invention.

Referring to FIG. 4, the cross-section of an end closure 2 according to one embodiment of the present invention (the 200 CDL-E IPSL end closure, shown in solid lines) is shown with the cross-section of an end closure according to another embodiment of the present invention (200 CDL-E DCL end closure, shown in dashed lines). These are the same end closures 2 shown in FIG. 3, but here the inclined linear panels 10 of the two embodiments are aligned.

Figure 17:
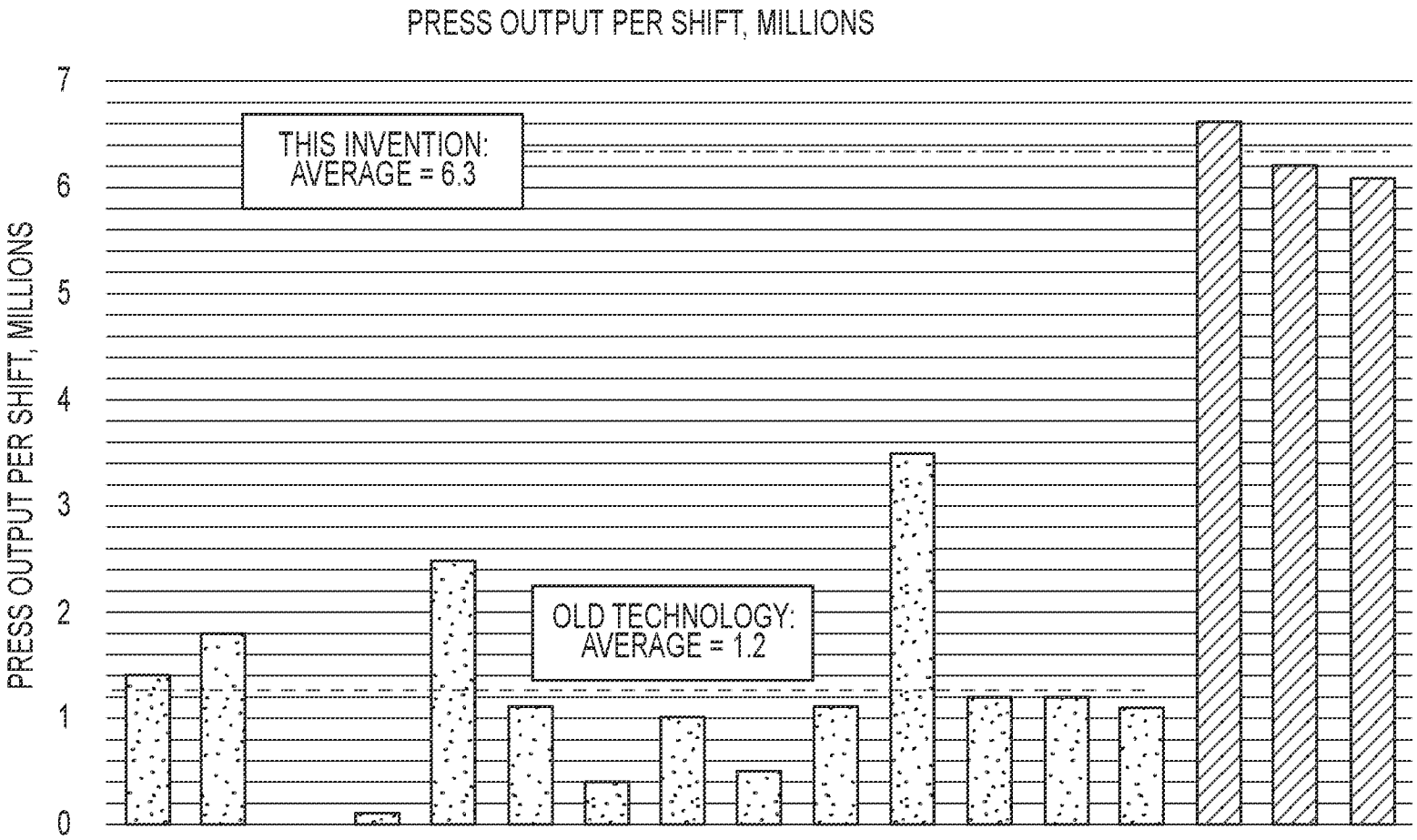
FIG. 17 is a graph showing the runability improvement of the new tooling and end closure.

End closures according to the present disclosure include a novel chuckwall 6, specifically the chuckwall 6 radius is novel and improves the mobility of the metal when forming the end closure, thus preventing inherent failures. The change in the radius of the chuckwall 6 improves the forming process of the end closure because the metal moves better, i.e., flows better, in the die core ring. Specifically, the die core ring (shown in FIG. 6) has a modified shape from prior art die core rings, which changes the shape of the chuckwall 6 of the end closure 2. As shown in FIG. 17, the changes in dimensions of the chuckwall 6 and die core ring increase the number of end closures made per shift by over 5 times, meaning over 5 times the number of end closures can be made each shift with the modified chuckwall 6 and die core ring.

Figure 5:
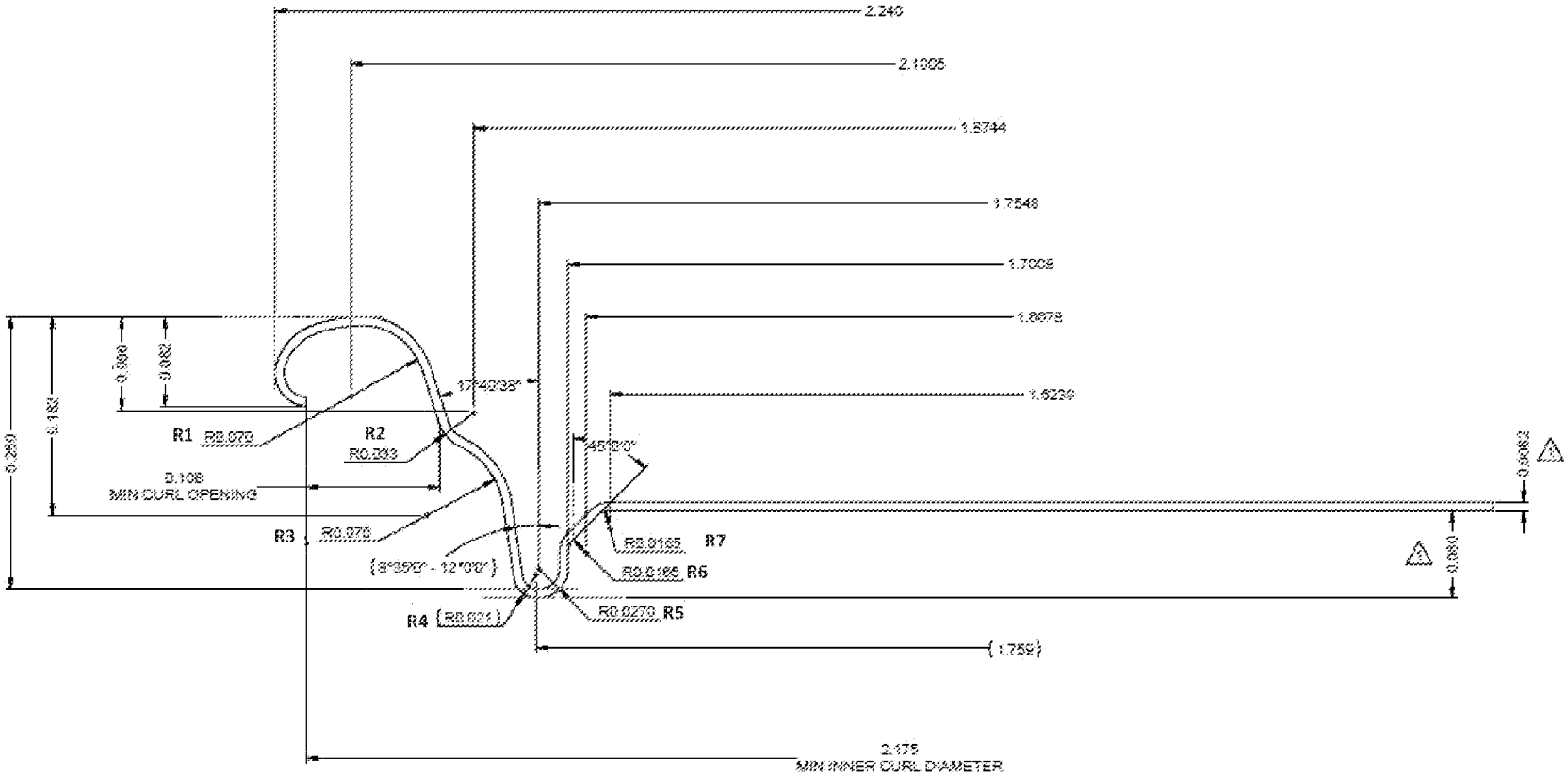
FIG. 5 is a cross-sectional view of one embodiment of the small-diameter end closure.

FIG. 5 is a cross-sectional view of one embodiment of the small-diameter end closure 2 before it is attached to a container. Specifically, FIG. 5 includes dimensional data for the 200 CDL-E end closure. In some embodiments, the diameter of the unseamed end closure as measured from an outermost edge of the peripheral curl 4 is between about 2.0 inches and about 2.50 inches, and in some embodiments 2.0 inches, 2.1 inches, 2.2 inches, 2.24 inches, 2.3 inches, 2.4 inches, and 2.5 inches, or a range or value between two of these values. In a preferred embodiment, the diameter of the unseamed end closure 2 as measured from an outermost edge of the peripheral curl 4 is about 2.240 inches. This is smaller than prior art 202 end closures and saves material, but still fits traditional metal cans. The material savings is important when manufacturing millions of end closures.

In some embodiments, the height of the top of the peripheral curl 4 above the lowest point of the countersink 8 is between about 0.2 inch and 0.3 inch. In a preferred embodiment, the height of the top of the peripheral curl 4 above the lowest point of the countersink 8 is about 0.25 inch. In some embodiments, the minimum opening of the peripheral curl 4 is between about 0.09 inch and 0.12 inch. In a preferred embodiment, the minimum opening of the peripheral curl 4 is about 0.108 inch.

In some embodiments, the peripheral curl 4 has a height (measured from the top of the peripheral curl 4 to the free end of the peripheral curl 4) of between about 0.075 inch and about 0.09 inch, in some embodiments 0.075 inch, 0.08 inch, 0.082 inch, 0.085 inch, 0.087 inch, and 0.09 inch, or a range or value between two of these values. In a preferred embodiment, the peripheral curl 4 has a height (measured from the top of the peripheral curl 4 to the free end of the peripheral curl 4) of about 0.082 inch.

The peripheral curl 4 comprises an upper curved portion that is interconnected to an inwardly oriented upper portion of the chuckwall 6. The upper portion of the chuckwall 6 is substantially linear when viewed in cross section and is connected to the peripheral curl 4 at a first junction having a radius of curvature R1. In some embodiments, R1 is between about 0.05 inch and about 0.09 inch, in some embodiments 0.05 inch, 0.055 inch, 0.06 inch, 0.065 inch, 0.07 inch, 0.075 inch, 0.08 inch, 0.085 inch, and 0.09 inch, or a range or value between two of these values. In a preferred embodiment, R1 is about 0.07 inch. The first junction radius of curvature R1 is oriented outwardly, meaning its center point is away from the center of the end closure.

The upper portion of the chuckwall 6 is interconnected at a second junction to a curved portion of the chuckwall 6. The second junction has a radius of curvature R2 between about 0.025 inch and about 0.04 inch, in some embodiments 0.025 inch, 0.03 inch, 0.033 inch, 0.035 inch, 0.038 inch, and 0.04 inch, or a range or value between two of these values. In a preferred embodiment, the second junction has a radius of curvature R2 of about 0.033 inch. The second junction radius of curvature R2 is oriented inwardly, meaning its center point is toward the center of the end closure 2. In prior art end closures, the radius of curvature R2 at the second junction was larger than 0.033 inches. By slightly reducing the radius of curvature R2 at the second junction in combination with R3 discussed below, significant improvements were seen in manufacturability. End closures of the prior art would get stuck in the machine, specifically the press would get jammed when discharging the prior art end closures, thus causing significant downtime and cost. The modified tooling changes the radius of curvature of the end closure chuckwall. This modification had the unexpected result of preventing the end closure from getting stuck and thus causing costly downtime. In some embodiments, the dimensional change in the tooling, specifically the die core ring, that forms the chuckwall improves the press output per shift (i.e., end closures made per shift) by over five (5) times, meaning five (5) times more end closures can be made per shift.

In some embodiments, the radius of curvature R3 of the curved portion of the chuckwall 6 is between about 0.06 inch and 0.08 inch, in some embodiments 0.06 inch, 0.065 inch, 0.07 inch, 0.075 inch, and 0.08 inch, or a range or value between two of these values. In a preferred embodiment, the radius of curvature R3 of the curved portion of the chuckwall 6 is about 0.07 inch and is oriented outwardly. In prior art end closures, the radius of curvature of the curved portion of the chuckwall 6 was smaller than 0.07 inches. By slightly increasing the radius of curvature R3 in combination with decreasing the radius of curvature R2 at the second junction, significant improvements were seen in manufacturability, as discussed above. The small changes in geometry created the unexpected result of being able to produce over five (5) times as many end closures per shift.

The curved portion of the chuckwall 6 interconnects to a substantially linear (when viewed in cross section) outer panel wall of the countersink 8. The outer panel wall is oriented outwardly at an angle between about 8° and about 12° in some embodiments 8°, 9°, 10°, 11°, and 12°, or a range or value between two of these values. The bottom portion of the countersink 8 has an outer radius of curvature R4 interconnected to the bottom of the outer panel wall. In some embodiments, the outer radius of curvature R4 is between about 0.015 inch and 0.03 inch, in some embodiments 0.015 inch, 0.017 inch, 0.02 inch, 0.021 inch, 0.025 inch, 0.028 inch, and 0.03 inch, or a range or value between two of these values. In a preferred embodiment, the outer radius of curvature R4 is about 0.021 inch. The bottom portion of the countersink 8 has an inner radius of curvature R5 interconnected to the bottom of the countersink inner panel wall. In some embodiments, the inner radius of curvature R5 is between about 0.02 inch and 0.035 inch, in some embodiments 0.02 inch, 0.025 inch, 0.027 inch, 0.03 inch, and 0.035 inch, or a range or value between two of these values. In a preferred embodiment, the inner radius of curvature R5 is about 0.027 inch. The inner radius R5 is interconnected to the outer radius R4 at the bottom of the countersink 8. The countersink inner panel wall is substantially linear, when viewed in cross section, and positioned substantially vertically. The countersink inner panel wall is interconnected to a substantially linear panel wall at a third junction. In some embodiments, the third junction has a radius of curvature R6 between about 0.01 inch and about 0.02 inch, in some embodiments 0.01 inch, 0.013 inch, 0.015 inch, 0.0165 inch, 0.017 inch, and 0.02 inch, or a range or value between two of these values. In a preferred embodiment, the third junction has a radius of curvature R6 of about 0.0165 inch.

The upper end of the inclined linear panel 10 is interconnected to the center panel 12 at a fourth junction having a radius of curvature R7. In some embodiments, the radius of curvature R7 of the fourth junction is between about 0.01 inch and about 0.02 inch, in some embodiments 0.01 inch, 0.013 inch, 0.015 inch, 0.0165 inch, 0.017 inch, and 0.02 inch, or a range or value between two of these values. In a preferred embodiment, the fourth junction has a radius of curvature R7 of about 0.0165 inch. In some embodiments, the inclined linear panel 10 is positioned at an angle of between about 30° and about 60° relative to a horizontal plane or axis, in some embodiments 30°, 35°, 40°, 45°, 50°, 55°, and 60°, or a range or value between two of these values. In a preferred embodiment, the inclined linear panel 10 is positioned at an angle of about 45° relative to a horizontal plane or axis.

In some embodiments, the diameter of the center panel 12 is between about 1.5 inches and about 1.75 inches, and in some embodiments, 1.5 inches, 1.55 inches, 1.6 inches, 1.6239 inches, 1.65 inches, 1.7 inches, and 1.75 inches, or a range or value between two of these values. In a preferred embodiment, the diameter of the center panel 12 is about 1.6239 inches.

In some embodiments, the radial length (measured horizontally) of the inclined linear panel 10 is between about 0.03 inch and 0.045 inch, and in some embodiments 0.03 inch, 0.035 inch, 0.03845 inch, 0.04 inch, and 0.045 inch, or a range or value between two of these values. In a preferred embodiment, the radial length (measured horizontally) of the inclined linear panel 12 is about 0.03845 inch. In some embodiments, the distance from the center of the countersink 8 on one side to the center of the countersink 8 on the other side (i.e., the diameter measured between the two points) is between about 1.5 inches and about 2.0 inches, and in some embodiments, 1.5 inches, 1.6 inches, 1.7 inches, 1.7548 inches, 1.8 inches, 1.9 inches, and 2.0 inches, or a range or value between two of these values. In a preferred embodiment, the distance from the center of the countersink 8 on one side to the center of the countersink 8 on the other side (i.e., the diameter measured between the two points) is about 1.7548 inches. Additional preferred dimensions can be found in FIG. 5. However, these dimensions may vary slightly in various embodiments.

Although many of the dimensions discussed herein are only slightly different from prior art end closures, the minimal changes in dimensions produced drastic improvements in manufacturability without reducing buckle strength, functionality, or the failure point of the actual end closure. Additionally, the changes in dimensions reduced the amount of material used for each end closure, creating large savings when manufacturing millions of end closures.

Figure 6:
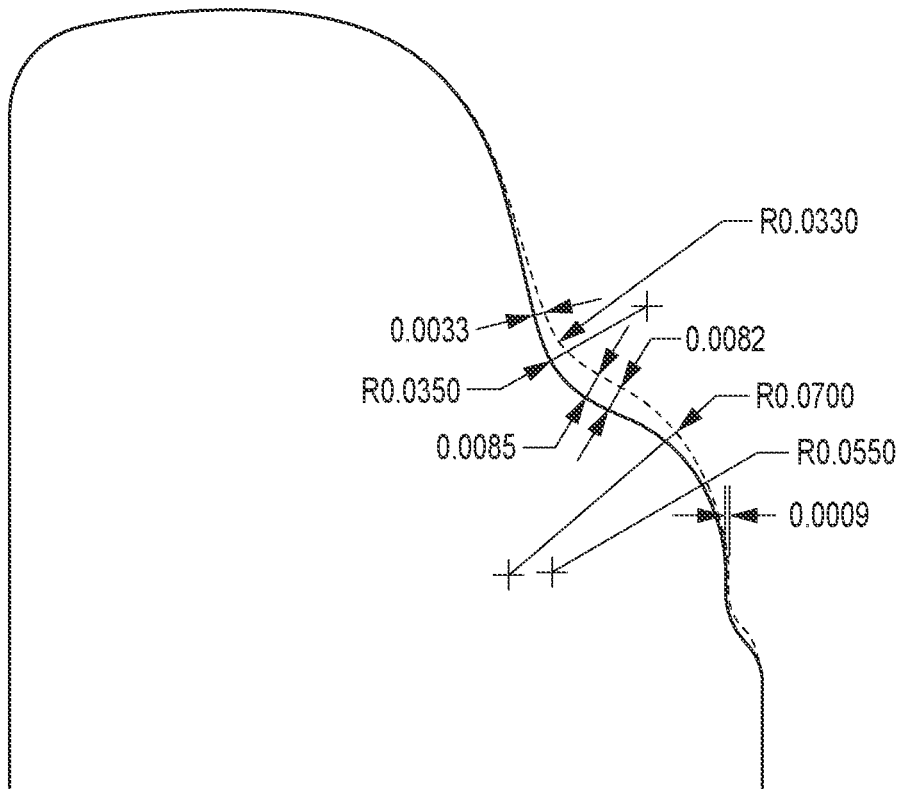
FIG. 6 shows a cross section of one embodiment of the new tool to manufacture the novel end closure superimposed on a cross section of the tool the manufacture a prior art end closure.
Figure 16:
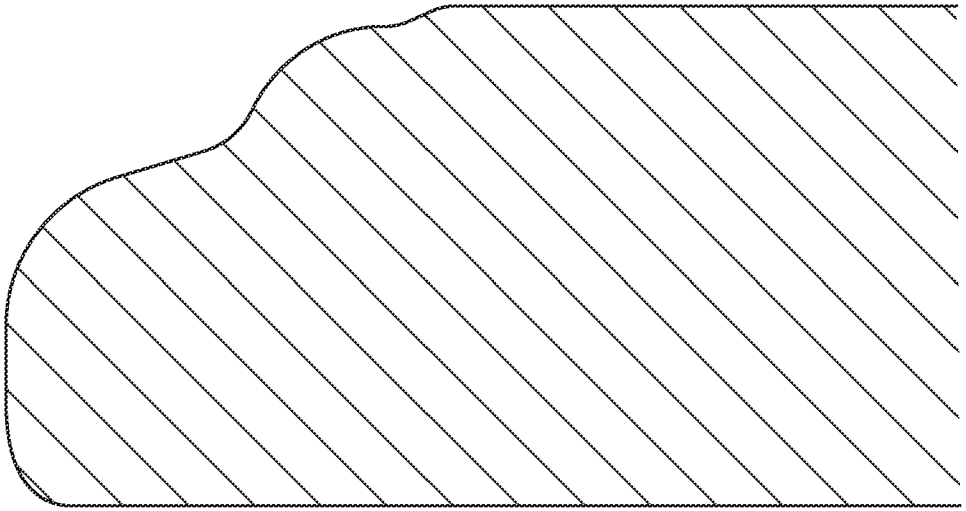
FIG. 16 is detail E from FIG. 16.

FIG. 6 shows a cross section of one embodiment of the tool used to manufacture the 200 CDL standard end closure (shown in solid lines) superimposed on a cross section of the tool the manufacture the prior art 200 CDL-E end closure (shown in dashed lines). Note that the profile of the tool for the 200 CDL standard end closure is sharper than the profile of the tool for the 200 CDL-E end closure. The new and improved tooling is the pink profile for the 200 CDL-E end closure. Specifically, the portion that forms the chuckwall is less sharp in the new tooling. The change in the tooling configuration effects the material flow during forming. The amount of bending angle (and unbending angle during drawing) changes the stress, and thus the strain, throughout the parts. Changes in tool radii result in differing normal forces and therefore change the friction retarding metal flow into the die cavity. The dimensional changes shown in FIG. 6 led to the significant improvement in press output efficiency and runability, as shown in FIG. 17. The geometry of the tooling of the present disclosure is new, and reduces various bends and angled portions found in the prior art tooling. For example, prior art tooling was sharper. Thus, the tooling according to the present disclosure has new (smaller) angles and less defined angles. The sharper configuration of the prior art tooling (200 CDL standard) did not have good runability because shells were jamming while exiting the press. The change in dimensions was expected to either have no benefit or a negative benefit, like many of the other parameters and steps changed while testing to improve the runability and reduce jamming. It is only with the dimensions disclosed herein (i.e., not smaller or larger dimensions) is the significant improvement in runability seen. More dimensions are shown in FIG. 16.

Figure 7:
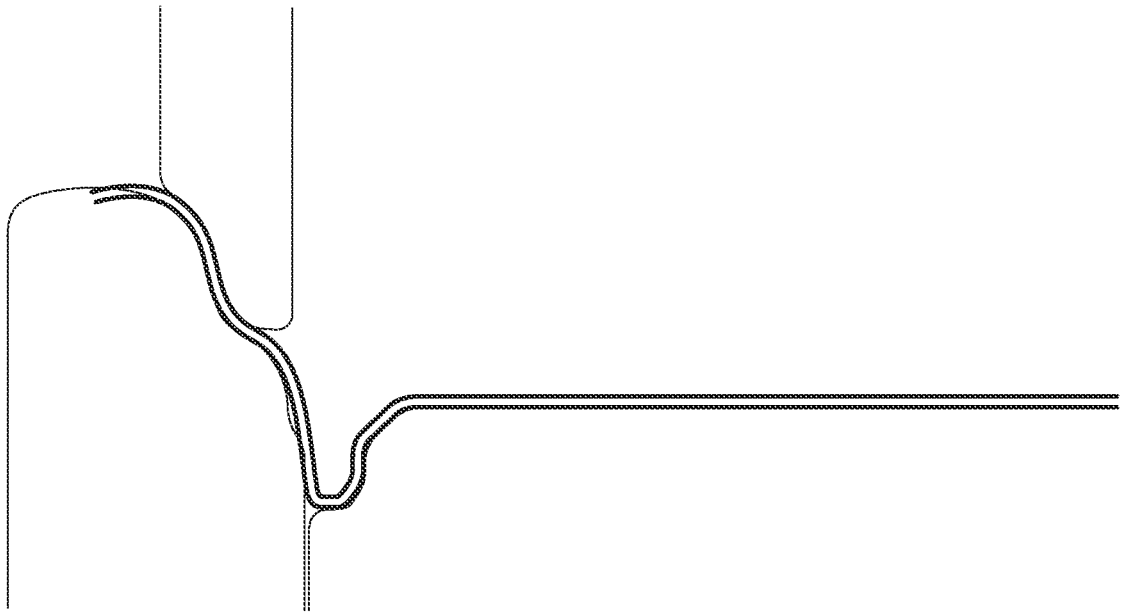
FIG. 7 shows a cross-section of the novel end closure positioned in the tooling to manufacture the end closure.

FIG. 7 shows a cross-section of the 200 CDL-E DCL end closure positioned in the tooling to manufacture this end closure. Note that the die core ring is designed for any 200 CDL-E end closure, the inner pressure sleeve is specifically designed for the 200 CDL-E DCL end closure, and the lower tooling is designed for the 200 CDL standard end closure.

Figure 8:
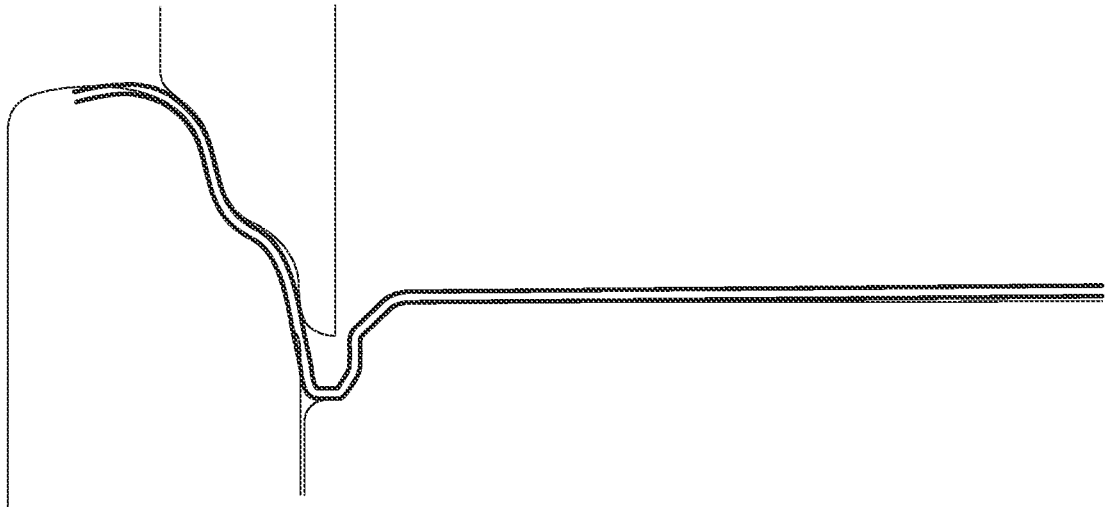
FIG. 8 shows a cross-section of another embodiment of the novel end closure positioned in the tooling to manufacture the end closure.

FIG. 8 shows a cross-section of the 200 CDL-E IPSL end closure positioned in the tooling to manufacture this end closure. Note that the die core ring is designed for any 200 CDL-E end closure, the inner pressure sleeve is specifically designed for the 200 CDL-E IPSL end closure, and the lower tooling is designed for the 200 CDL standard end closure.

Figure 9:
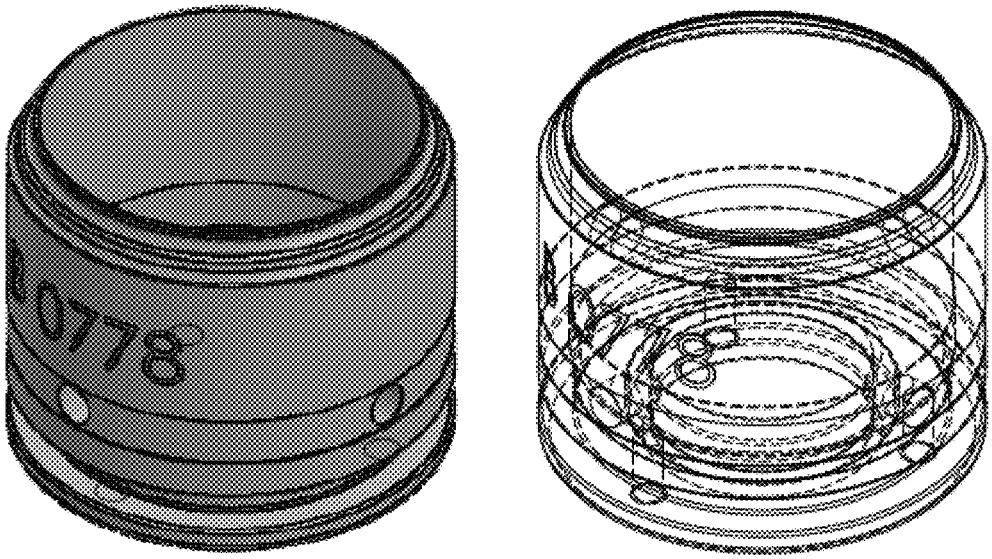
FIG. 9 is a perspective view of one embodiment of the inner pressure sleeve.
Figure 10:
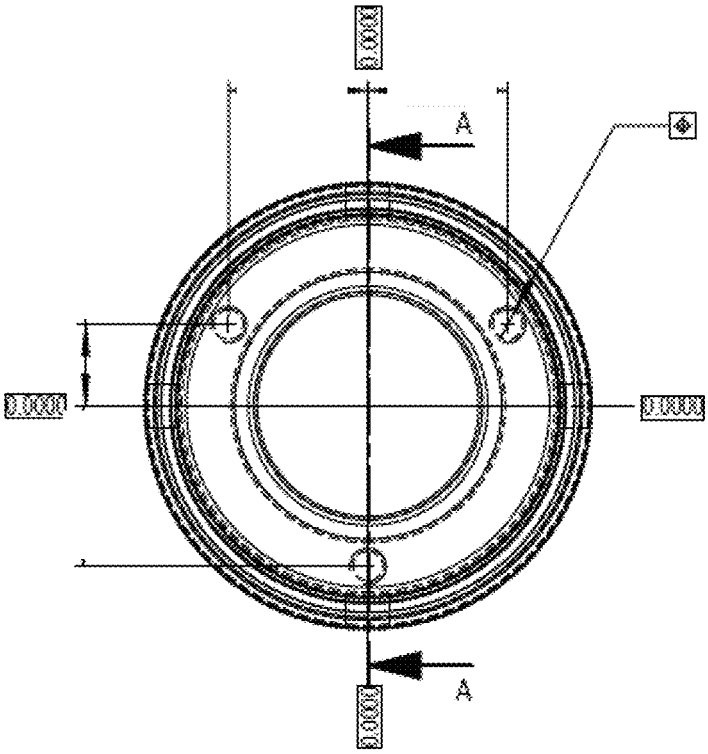
FIG. 10 is a top plan view of the inner pressure sleeve.
Figure 11:
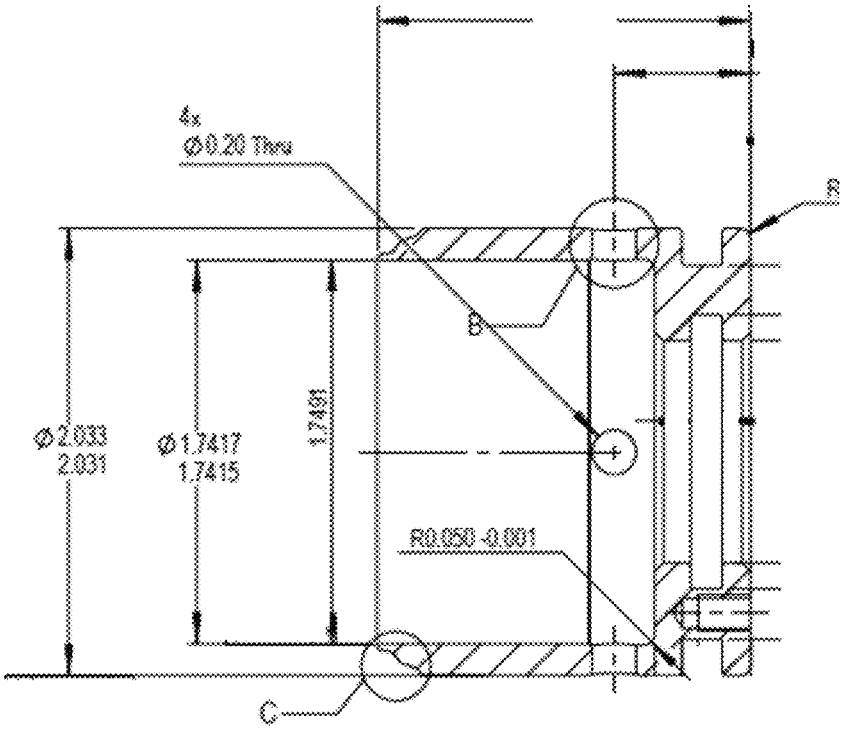
FIG. 11 is a cross-sectional view of section A-A taken from FIG. 10.
Figure 12:
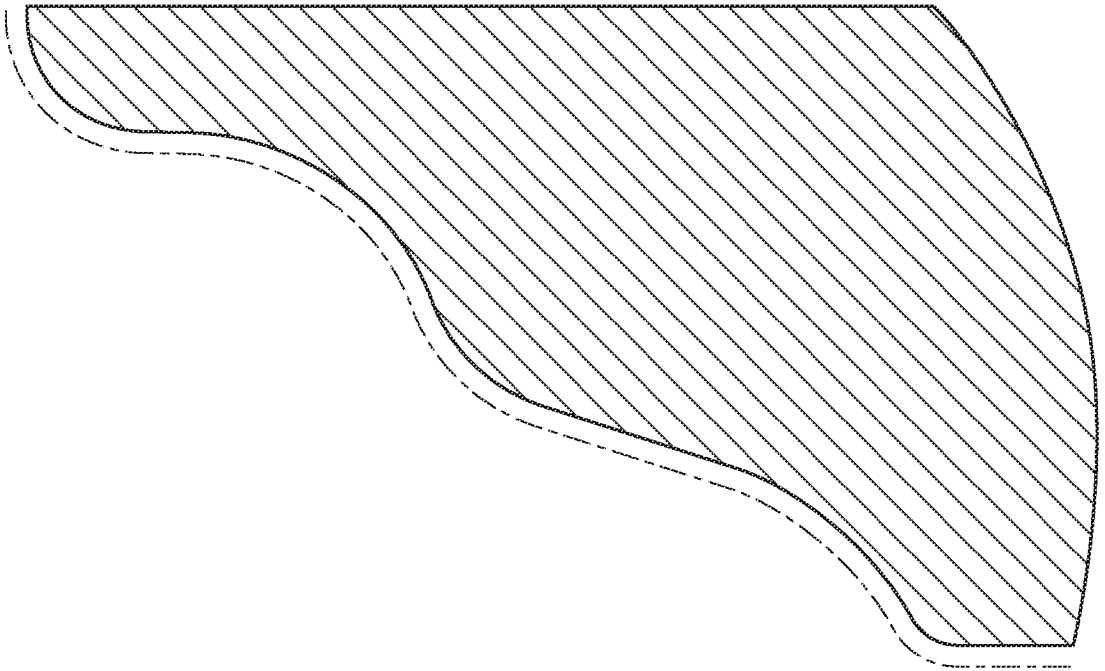
FIG. 12 is detail C from FIG. 11.

FIG. 9 is a perspective view of one embodiment of the inner pressure sleeve. FIG. 10 is a top plan view of the inner pressure sleeve. FIG. 11 is a cross-sectional view of section A-A taken from FIG. 10. FIG. 12 is detail C from FIG. 11.

Figure 13:
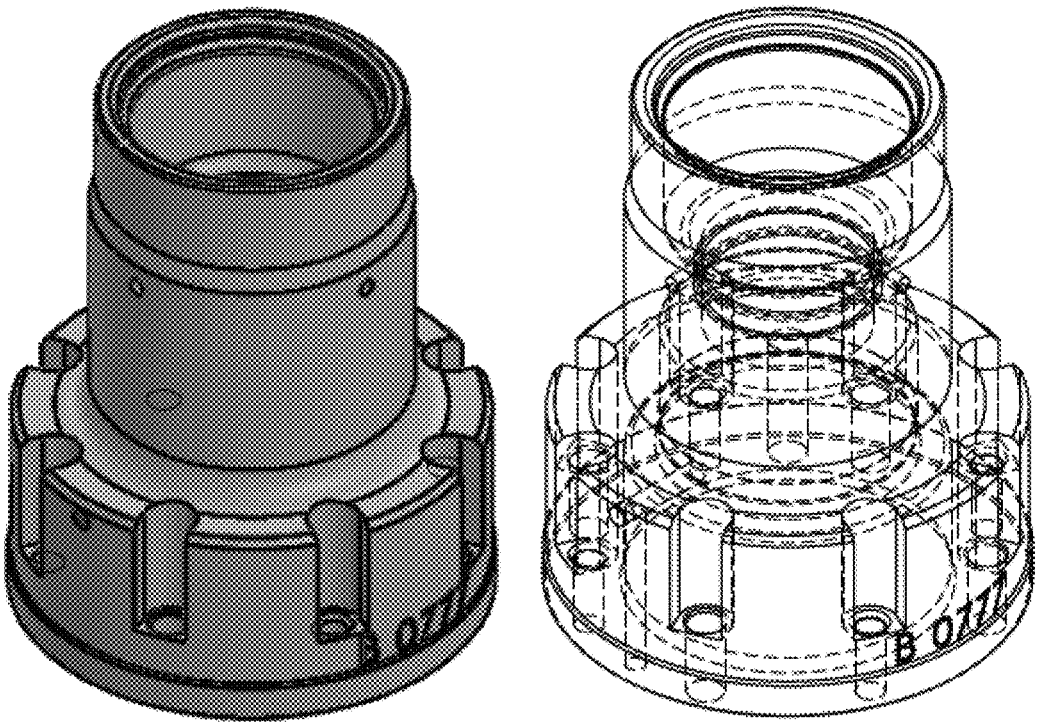
FIG. 13 is a perspective view of one embodiment of the die core ring.
Figure 14:
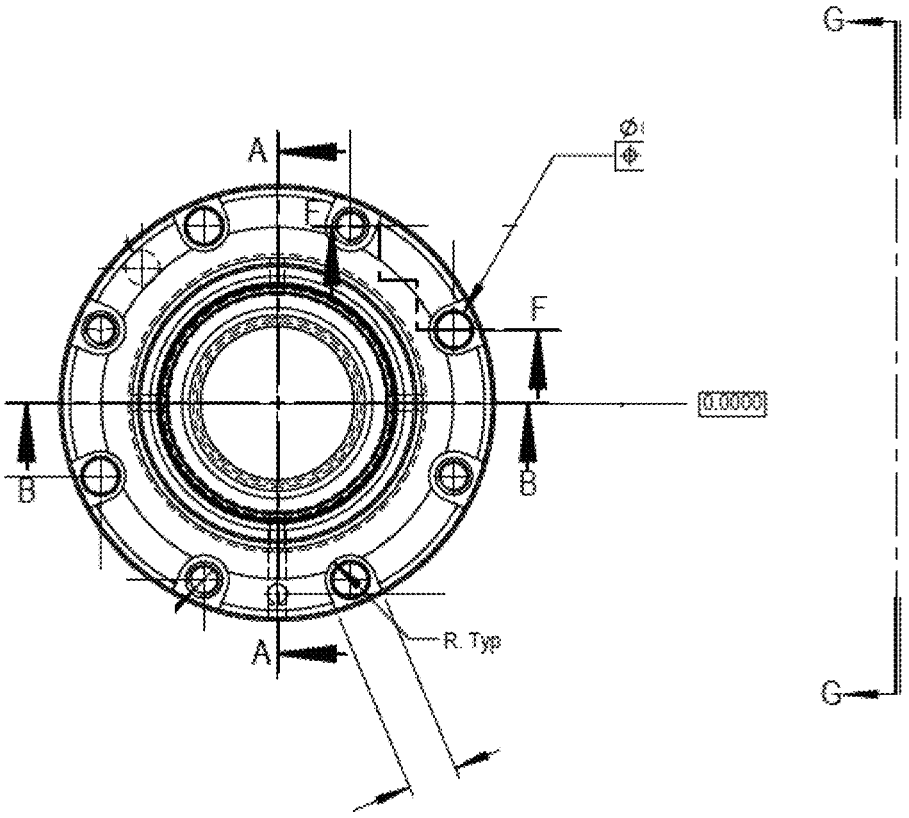
FIG. 14 is a top plan view of the die core ring.
Figure 15:
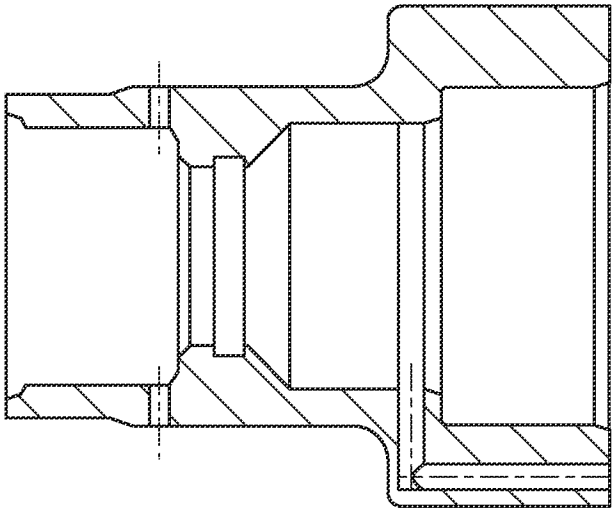
FIG. 15 is a cross-sectional view of section A-A taken from FIG. 14.

FIG. 13 is a perspective view of one embodiment of the die core ring. FIG. 14 is a top plan view of the die core ring. FIG. 15 is a cross-sectional view of section A-A taken from FIG. 14. FIG. 16 is detail E from FIG. 15.

FIG. 17 graphically shows the runability improvement of the new tooling and end closure. Specifically, the old tooling and end closure would jam the press and only about 1.2 million end closures could be made each shift. The modified tooling and end closure according the present disclosure increases the number of end closures made per shift to 6.3 million. This is an improvement of about 5.25 times the number of end closures made per shift. Such a large improvement is not typical in the present field.

In some embodiments, the end closure comprises a coating to prevent corrosion, leaching, and other undesirable side effects from a metallic end closure contacting a pressurized and possibly acidic beverage. In various embodiment, the coating is a BPANI coating (Sherwin 32SO2). In additional embodiments, the coating is applied to the metal sheet prior to the end closure being formed.

Embodiments of the end closure described herein are less likely to stick in the manufacturing equipment due to the specific coating used and the new angle on the tooling, i.e., the new geometry and radii on the die core ring and inner pressure sleeve. Presses, the machines that make the end closures, typically operate at 600 strokes per minute. End closures of the prior art would get stuck in the machine, specifically the press would get jammed during discharge, thus causing hours of down time. End closures according to the present disclosure get stuck significantly less often, thus allowing the machines to operate continuously with much less downtime or time offline.

In some embodiments, the end closure has a thickness between about 0.203 mm and about 0.208 mm, or 0.203 mm, 0.204 mm, 0.205 mm, 0.206 mm, 0.207 mm, and 0.208 mm, or a range or value between two of these values. In a preferred embodiment, the thickness of the end closure is about 0.203 mm. "About" as used herein can mean a deviation of +/−10% unless otherwise specified. In other embodiments, the end closure has a thickness between about 0.20 mm and about 0.21 mm, or 0.20 mm, 0.202 mm, 0.204 mm, 0.206 mm, 0.208 mm, and 0.21 mm, or a range or value between two of these values.

While various embodiments of the present invention have been described in detail, it is apparent that modifications and alterations of those embodiments will occur to those skilled in the art. However, it is to be expressly understood that such modifications and alterations are within the scope and spirit of the present invention, as set forth in the following claims. Further, the invention(s) described herein is capable of other embodiments and of being practiced or of being carried out in various ways. It is to be understood that the phraseology and terminology used herein is for the purpose of description and should not be regarded as limiting.

What is claimed is:

1. A metallic end closure, comprising:

a peripheral curl which is adapted for interconnection to a neck of a beverage container;

a chuckwall extending downwardly from the peripheral curl, the chuckwall comprising:

an upper portion that is inwardly oriented and interconnected to the peripheral curl at a first junction having a first radius of curvature when viewed in cross-section; and a curved portion that is inwardly oriented and interconnected to the upper portion at a second junction having a second radius of curvature of between about 0.03 inch and about 0.035 inch when viewed in cross-section, wherein the second radius of curvature of the second junction is measured from a side of the chuckwall facing a center of the metallic end closure, and wherein the curved portion has a third radius of curvature of between about 0.065 inch and about 0.075 inch when viewed in cross-section;

a countersink, comprising:

an outer panel wall having an upper end interconnected to a lower end of the curved portion of the chuckwall;

a curved bottom portion having an outer portion and an interior portion, wherein the outer portion is interconnected to a lower end of the outer panel wall; and an inner panel wall extending upwardly from the interior portion of the countersink;

a substantially linear panel wall interconnected to an upper portion of the inner panel wall;

a center panel interconnected to an upper portion of the substantially linear panel wall;

a pull tab having a nose end and a tail end which is operably interconnected to the center panel;

a first score line in the center panel which defines a tear panel; and a maximum outer diameter measured between radially outermost portions of the peripheral curl of between 2.1 inches and 2.240 inches.

2. The metallic end closure of claim 1, wherein an uppermost point of the peripheral curl is positioned between about 0.2 inch and 0.3 inch above a lowermost portion of the countersink.

3. The metallic end closure of claim 1, wherein the curved portion of the chuckwall has a concave shape oriented outwardly when viewed in cross-section.

4. The metallic end closure of claim 1, wherein the substantially linear panel wall is positioned at an angle between about 30° and about 60° relative to a horizontal plane.

5. The metallic end closure of claim 1, wherein the curved bottom portion of the countersink comprises an inner radius of curvature and an outer radius of curvature when viewed in cross-section, wherein the inner radius of curvature is between about 0.02 inch and 0.035 inch and the outer radius of curvature is between about 0.015 inch and 0.03 inch.

6. A method of manufacturing a metallic end closure, comprising:

providing a metallic blank; and forming the metallic blank into an end closure comprising:

a peripheral curl which is adapted for interconnection to a neck of a beverage container;

a chuckwall extending downwardly from the peripheral curl, the chuckwall comprising:

an upper portion that is inwardly oriented and interconnected to the peripheral curl at a first junction having a first radius of curvature when viewed in cross-section; and a curved portion that is inwardly oriented and interconnected to the upper portion at a second junction having a second radius of curvature of between about 0.03 inch and about 0.035 inch when viewed in cross-section, wherein the second radius of curvature of the second junction is measured from a side of the chuckwall facing a center of the metallic end closure, and wherein the curved portion has a third radius of curvature of between about 0.065 inch and about 0.075 inch when viewed in cross-section;

a countersink, comprising:

an outer panel wall having an upper end interconnected to a lower end of the curved portion of the chuckwall;

a curved bottom portion having an outer portion and an interior portion, wherein the outer portion is interconnected to a lower end of the outer panel wall; and an inner panel wall extending upwardly from the interior portion of the countersink;

a center panel interconnected to an upper portion of the inner panel wall;

a pull tab having a nose end and a tail end which is operably interconnected to the center panel;

a first score line in the center panel which defines a tear panel; and a maximum outer diameter measured between radially outermost portions of the peripheral curl of between 2.1 inches and 2.240 inches.

7. A metallic beverage container, comprising:

a container body comprising a closed bottom end, an open upper end, and a cylindrical sidewall;

a neck interconnected to the open upper end of the container body; and an end closure interconnected to the neck by a seam, the end closure comprising:

a chuckwall extending downwardly from the seam, the chuckwall comprising:

an upper portion that is inwardly oriented and interconnected to the seam at a first junction having a first radius of curvature when viewed in cross-section; and a curved portion that is inwardly oriented and interconnected to the upper portion at a second junction having a second radius of curvature of between about 0.03 inch and about 0.035 inch when viewed in cross-section, wherein the second radius of curvature of the second junction is measured from a side of the chuckwall facing a center of the end closure, and wherein the curved portion has a third radius of curvature of between about 0.065 inch and about 0.075 inch when viewed in cross-section;

a countersink, comprising:

an outer panel wall having an upper end interconnected to a lower end of the curved portion of the chuckwall;

a curved bottom portion having an outer portion and an interior portion, wherein the outer portion is interconnected to a lower end of the outer panel wall; and an inner panel wall extending upwardly from the interior portion of the countersink;

a substantially linear panel wall interconnected to an upper portion of the inner panel wall;

a center panel interconnected to an upper portion of the substantially linear panel wall;

a pull tab having a nose end and a tail end which is operably interconnected to the center panel; and a first score line in the center panel which defines a tear panel.

8. The metallic beverage container of claim 7, wherein before the end closure is interconnected to the neck by the seam, the end closure comprises a peripheral curl with a maximum outer diameter of between 2.1 inches and 2.240 inches measured between radially outermost portions of the unseamed peripheral curl.

9. The metallic beverage container of claim 7, wherein the curved portion of the chuckwall has a concave shape oriented outwardly when viewed in cross-section.

* * * * *